US010343440B2

(12) United States Patent
Hachmann et al.

(10) Patent No.: US 10,343,440 B2
(45) Date of Patent: Jul. 9, 2019

(54) METHOD FOR PRINTING ON ABSORBENT PRINTING MATERIAL USING INKS AND DAMPENING FLUIDS

(71) Applicant: HEIDELBERGER DRUCKMASCHINEN AG, Heidelberg (DE)

(72) Inventors: Peter Hachmann, Weinheim-Hohensachsen (DE); Klaus Olawsky, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/027,811

(22) Filed: Jul. 5, 2018

(65) Prior Publication Data

US 2019/0009604 A1 Jan. 10, 2019

(30) Foreign Application Priority Data

Jul. 5, 2017 (DE) ..... 10 2017 211 456

(51) Int. Cl.
*B41M 7/00* (2006.01)
*B41J 11/00* (2006.01)
*B41M 5/00* (2006.01)

(52) U.S. Cl.
CPC ..... *B41M 7/0018* (2013.01); *B41J 11/0005* (2013.01); *B41M 5/0011* (2013.01); *B41J 11/0015* (2013.01)

(58) Field of Classification Search
CPC .. B41M 7/0018; B41J 11/0015; B41J 11/0005
See application file for complete search history.

(56) References Cited

U.S. PATENT DOCUMENTS 6,158,856 A 12/2000 Sato et al.
7,619,778 B2 * 11/2009 Inoue ..... H04N 1/4058 358/3.06
8,708,479 B2 4/2014 Link
(Continued)

FOREIGN PATENT DOCUMENTS

DE 69624854 T2 7/2003
DE 102010060409 A1 5/2012
(Continued)

*Primary Examiner* — John Zimmermann
(74) *Attorney, Agent, or Firm* — Laurence A. Greenberg; Werner H. Stemer; Ralph E. Locher

(57) ABSTRACT

A method prints on a printing material using inks and dampening fluids. An ink printing machine uses ink print heads to apply an image to a front side of the printing material and a dampening fluid print head to apply a dampening fluid image, thus reducing or avoiding water-related cockling of the printing material. The method includes: providing the image to be printed, calculating n different color separation matrices, calculating n ink amount matrices $A_n$ from the color separation matrices, and calculating a total ink amount matrix A. For every element of the total ink amount matrix: calculating a matrix B as B=G*A, with a weighting matrix G and determining the maximum of the matrix B, calculating a dampening fluid matrix C, calculating the dampening fluid image from the dampening fluid image matrix C, and printing the ink image and the dampening fluid image.

13 Claims, 6 Drawing Sheets

(56) References Cited

U.S. PATENT DOCUMENTS

| | | | | |
|---|---|---|---|---|
| 9,193,177 | B1 | 11/2015 | Lefevre et al. | |
| 2009/0256896 | A1 | 10/2009 | Scarlata | |
| 2013/0258414 | A1* | 10/2013 | Kikuta ..... | G06K 15/1876 358/3.14 |
| 2017/0341418 | A1 | 11/2017 | Paul et al. | |

FOREIGN PATENT DOCUMENTS

| | | | |
|---|---|---|---|
| DE | 102016209079 | B3 | 6/2017 |
| JP | 2006264185 | A | 10/2006 |
| JP | 2007250494 | A | 9/2007 |

* cited by examiner

```
[[4.30 1.00 2.00 1.00 2.00 2.00 3.00 3.00 3.00 3.00 3.00]
 [4.30 1.00 1.00 1.00 2.00 2.00 2.00 2.00 3.00 3.00 3.00]
 [4.30 4.30 4.30 1.00 1.00 2.00 2.00 2.00 2.00 3.00 3.00]
 [4.30 4.30 2.00 1.00 2.00 2.00 2.00 3.00 4.00 4.00 4.00]
 [4.30 3.00 2.00 0.20 0.20 0.20 0.00 0.00 0.00 0.00 0.00]   ← A
 [3.00 2.00 0.50 0.20 0.20 0.20 0.00 0.00 0.00 0.00 0.00]
 [2.00 0.50 0.50 0.20 0.20 0.00 0.00 0.00 0.00 0.00 0.00]
 [0.00 0.00 0.00 0.20 0.00 0.00 0.00 0.00 0.00 0.00 0.00]
 [0.00 0.00 0.00 0.00 0.00 0.00 0.00 0.00 0.00 0.00 0.00]
 [0.00 0.00 0.00 0.00 0.00 0.00 0.00 0.00 0.00 0.00 0.00]
 [0.00 0.00 0.00 0.00 0.00 0.00 0.00 0.00 0.00 0.00 0.00]]
```

```
[[ 0.00 0.00 0.00 0.00 0.00 0.00 0.00 0.00 0.00 0.00 0.00]
 [ 0.00 0.00 0.00 0.11 0.18 0.20 0.18 0.11 0.00 0.00 0.00]
 [ 0.00 0.00 0.15 0.28 0.37 0.40 0.37 0.28 0.15 0.00 0.00]
 [ 0.00 0.11 0.28 0.43 0.55 0.60 0.55 0.43 0.28 0.11 0.00]
 [ 0.00 0.18 0.37 0.55 0.72 0.80 0.72 0.55 0.37 0.18 0.00]
 [ 0.00 0.20 0.40 0.60 0.80 1.00 0.80 0.60 0.40 0.20 0.00]
 [ 0.00 0.18 0.37 0.55 0.72 0.80 0.72 0.55 0.37 0.18 0.00]
 [ 0.00 0.11 0.28 0.43 0.55 0.60 0.55 0.43 0.28 0.11 0.00]
 [ 0.00 0.00 0.15 0.28 0.37 0.40 0.37 0.28 0.15 0.00 0.00]
 [ 0.00 0.00 0.00 0.11 0.18 0.20 0.18 0.11 0.00 0.00 0.00]
 [ 0.00 0.00 0.00 0.00 0.00 0.00 0.00 0.00 0.00 0.00 0.00]]
```

← G

[[4.30 3.44 2.58 2.38 2.00 2.40 3.00 3.00 3.00 3.00 3.00]
[4.30 3.44 3.44 3.08 2.38 2.15 2.40 2.40 3.00 3.00 3.00]
[4.30 4.30 4.30 3.44 2.58 2.00 2.21 2.87 3.20 3.20 3.20]
[4.30 4.30 3.44 3.08 2.38 2.00 2.40 3.20 4.00 4.00 4.00]
[4.30 3.44 3.08 2.38 1.87 1.66 2.21 2.87 3.20 3.20 3.20]
[3.44 3.08 2.38 1.87 1.20 1.30 1.74 2.21 2.40 2.40 2.40]
[2.58 2.38 1.87 1.30 0.87 0.84 1.12 1.47 1.60 1.60 1.60]
[1.80 1.66 1.30 0.87 0.56 0.40 0.53 0.70 0.80 0.80 0.80]
[1.20 1.11 0.87 0.56 0.30 0.14 0.09 0.06 0.03 0.00 0.00]
[0.80 0.74 0.56 0.30 0.14 0.09 0.06 0.03 0.00 0.00 0.00]
[0.40 0.35 0.21 0.09 0.07 0.06 0.03 0.00 0.00 0.00 0.00]]

← B

[[ 0.00 2.44 0.58 1.38 0.00 0.40 0.00 0.00 0.00 0.00 0.00]
[ 0.00 2.44 2.44 2.08 0.38 0.15 0.40 0.40 0.00 0.00 0.00]
[ 0.00 0.00 0.00 2.44 1.58 0.00 0.21 0.87 1.20 0.20 0.20]
[ 0.00 0.00 1.44 2.08 0.38 0.00 0.40 0.20 0.00 0.00 0.00]
[ 0.00 0.44 1.08 2.18 1.67 1.46 2.21 2.87 3.20 3.20 3.20]
[ 0.44 1.08 1.88 1.67 1.00 1.10 1.74 2.21 2.40 2.40 2.40] ← C
[ 0.58 1.88 1.37 1.10 0.67 0.84 1.12 1.47 1.60 1.60 1.60]
[ 1.80 1.66 1.30 0.67 0.56 0.40 0.53 0.70 0.80 0.80 0.80]
[ 1.20 1.11 0.87 0.56 0.30 0.14 0.09 0.06 0.03 0.00 0.00]
[ 0.80 0.74 0.56 0.30 0.14 0.09 0.06 0.03 0.00 0.00 0.00]
[ 0.40 0.35 0.21 0.09 0.07 0.06 0.03 0.00 0.00 0.00 0.00]]

METHOD FOR PRINTING ON ABSORBENT PRINTING MATERIAL USING INKS AND DAMPENING FLUIDS

CROSS-REFERENCE TO RELATED APPLICATION

This application claims the priority, under 35 U.S.C. § 119, of German application DE 10 2017 211 456.8, filed Jul. 5, 2017; the prior application is herewith incorporated by reference in its entirety.

BACKGROUND OF THE INVENTION

Field of the Invention

The present invention relates to a method that has the features described in the preamble of the main claim.

The technical field of the invention is the field of the graphic arts industry, in particular the field of industrial ink jet printing on flat substrates, i.e. the application of liquid ink to sheet-shaped or web-shaped printing materials, preferably made of paper, cardboard, or plastics.

In the known drop-on-demand (DOD) ink printing processes, the application of liquid ink to create a print on a flat printing material is achieved by an ink jet print head (in short: a head) that has individually controllable nozzle openings for generating tiny ink drops, preferably in a picoliter range, in accordance with the image to be printed. These drops are transferred to the printing material as print dots in a contact-free way.

In what is known as water-based ink printing, the liquid ink contains water to carry the colorant, in particular a pigment. The colorant is transferred to the printing material by a drop generated by the ink print head. The water, which is likewise transferred to the printing material, is subsequently removed, preferably by thermal drying.

In water-based ink printing, undesired waves may occur in the printing material (known as cockling), in particular if thin substrates are printed on, due to the water that is transferred to the printing material. This effect may be intensified by an uneven transfer of water, for instance if a large amount of water is transferred to printed areas and little or no water is transferred to unprinted areas. In this case, the borders of the printed regions may exhibit increased waviness.

A solution to this problem might be seen in dampening all unprinted areas of the substrate. However, this would cause large amounts of moisture to be transferred to the substrate, resulting in a more difficult subsequent drying process and in particular increased energy consumption required for the purpose. If transparent ink was used to dampen the substrate, the printing costs would rise considerably.

Published, non-prosecuted German patent application DE 10 2010 060 409 A1, corresponding to U.S. Pat. No. 8,708,479, discloses a method to reduce the curling in a printing material that is printed on using water-containing ink. The method makes use of ink print heads and a print head for a transparent, water-containing liquid. The transfer of the ink and the liquid is achieved in such a way that the moisture differential between the printed areas and the unprinted areas is reduced. It is possible to create a graded moisture transfer with descending moisture levels from the printed area via area parts and further area parts. Despite the gradation, there may nevertheless be cockling (albeit to a lesser extent) that is still detrimental to the high degree of print quality requested by the customers.

U.S. patent publication No. 2009/0256896 A1 describes a similar solution and what is referred to as a controller for controlling the amount of liquid to be transferred. However, there is no further description of how the amount is controlled. The same applies to U.S. Pat. No. 9,193,177 B1.

SUMMARY OF THE INVENTION

Against this background, an object of the present invention is to provide a method that is an improvement over the prior art and allows undesired cockling in water-based ink printing to be further reduced to meet high and even highest quality requirements for industrially produced printed products.

In accordance with the invention, this object is attained by the method described in the main claim.

Advantageous and thus preferred further developments of the present invention will become apparent from the dependent claims as well as from the description and drawings.

The invention relates to a method for printing on absorbent printing material using inks and dampening fluids. Both the inks and the dampening fluid contain water as a solvent and the dampening fluid is colorless. An ink printing machine having at least two ink print heads and at least one dampening fluid print head is provided. The at least two ink print heads apply an ink image to be printed to a front side of the printing material and the at least one dampening fluid print head applies a dampening fluid image to the front side of the printing material, in particular a dampening fluid image that surrounds the ink image, thus reducing or avoiding water-related cockling of the absorbent printing material. A computer is provided. The method includes the steps of:

providing the image to be printed onto the front side of the printing material, in particular a RGB image;

calculating n different color separation matrices with $n \in \mathbb{N}$ and with $n \geq 2$;

calculating n ink amount matrices $A_n$ from the n different color separation matrices of the image;

calculating a total ink amount matrix A as A=A1+A2+ . . . +An;

for every element A(i, j) of the total ink amount matrix A: calculating a matrix $B_{i,j}$ with $B_{i,j}=G*A$, i.e. by multiplying the total ink amount matrix A by a provided weighting matrix G, and determining the maximum of $Max_{i,j}$ of the matrix B;

calculate a dampening fluid matrix C with $C(i,j)=Max_{i,j}-A(i,j)$;

calculating a dampening fluid image to be printed onto the front side of the printing material from the dampening fluid matrix C;

screening the color separation matrices of the ink image using a raster image processor;

screening the dampening fluid image using the raster image processor;

printing the ink image; and printing the dampening fluid image.

The invention advantageously allows undesired cockling in water-based ink printing to be further reduced and thus high and highest quality requirements for industrially produced printed products may be met.

The invention advantageously does not envisage dampening the entire area of the printing material but only a selected border zone around the printed image. This saves dampening fluid and reduces costs (both in terms of dampening fluid consumption and drying power). Another advantage is that the dampening fluid is not transferred in accordance with a coarsely stepped pattern but rather in a continuous or quasi-continuous way, i.e. more finely so as to thin out (away from the image border), in the shape of a gradient or the like. The transfer of the dampening fluid in the dampening fluid image may advantageously occur in a location-resolved way, adapted to the amount of water present in the ink at neighboring locations in the ink image in a location-resolved way, thus providing a smooth transition. Another advantage is that in accordance with the invention, even thin papers may be printed on without any detrimental visible cockling and even papers that are not specifically designed and equipped (e.g. specifically coated) for ink jet printing, such as papers for lithographic offset printing, may be used.

In accordance with the invention, the calculation of the dampening fluid image occurs between the steps of calculating the color separation matrices and screening. At an earlier or later point, the calculation of the dampening fluid image would not be possible because it is not clear how much ink (individually and in total) is present at which location of the ink image.

A preferred further development of the invention may be characterized in that the color separation matrices of the image are calculated as CMYK matrices or CMYKOGV matrices. The black color separation (K), in particular for text to be printed, may be factored out of the method because screening may not be necessary.

A preferred further development of the invention may be characterized in that the ink amount matrices A are calculated using a provided relationship $T_1$ between the intensity or optical density and layer thickness, in particular using the Tollenaar curve.

A preferred further development of the invention may be characterized in that a respective weighting $g\mathbf{1}_n$ of the n ink amount matrices $A_n$ is factored in when the total ink amount matrix A is calculated A preferred further development of the invention may be characterized in that the weighting matrix G is provided as a matrix that is conical at the center in terms of the progression of the values of the elements G(i, j) thereof and filled with zero at the borders.

A preferred further development of the invention may be characterized in that a weighting g2 of the elements of $Max_{i,j}$ and $A(_{i,j})$ in accordance with the respective water content of the dampening fluid and of the inks is factored in when the dampening fluid amount matrix C is calculated.

A preferred further development of the invention may be characterized in that the dampening fluid image is calculated using a provided relationship $T_2$ between intensity and layer thickness, in particular using the Tollenaar curve or the inverse thereof.

A preferred further development of the invention may be characterized by the steps of carrying out the characterizing steps of providing, calculating, and determining of the method of the invention for a further image to be printed onto the back side of the printing material, comparing the value of the ink image or of the dampening fluid image on the front side and the corresponding back-side value of the ink image or dampening fluid image of the back side at every location of the printing material to be printed on, and transferring the greater value obtained in the comparison of the one image to the corresponding other image.

A preferred further development of the invention may be characterized in that the print resolution of the dampening fluid print head is lower than that of the ink print head.

A preferred further development of the invention may be characterized in that the computer is provided to carry out calculating, determining, and comparing steps.

The invention as well as preferred further developments thereof will be explained in more detail below with reference to the drawings and based on a preferred exemplary embodiment.

Other features which are considered as characteristic for the invention are set forth in the appended claims.

Although the invention is illustrated and described herein as embodied in a method for printing on absorbent printing material using inks and dampening fluids, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
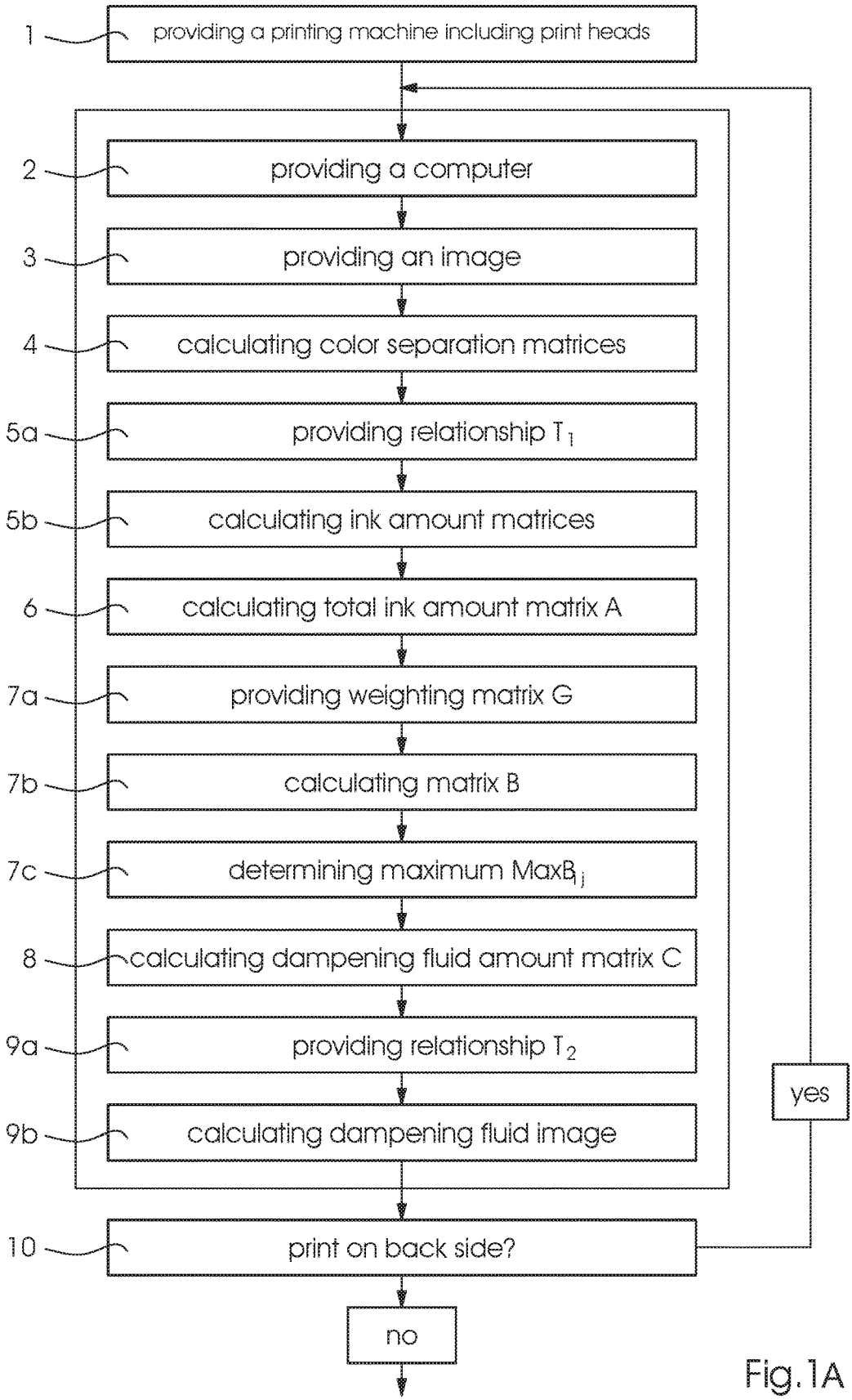
FIG. 1A is a flow chart illustrating a preferred exemplary embodiment of a first part of a method of the invention.
Figure 1B:
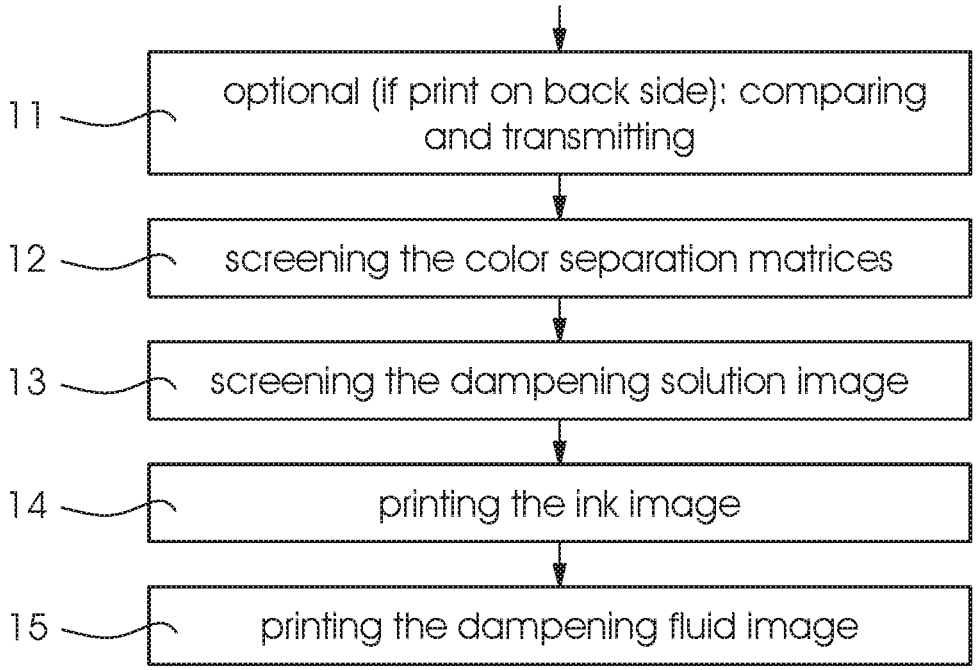
FIG. 1B is a flow chart illustrating a preferred exemplary embodiment of a second part of a method of the invention.

Referring now to the figures of the drawings in detail and first, particularly to FIGS. 1A and 1B thereof, there is shown a preferred exemplary embodiment of a method of the invention in accordance with steps 1 to 15. The individual steps of the method will be described in detail below with further reference to the further FIGS. 2 to 5.

In step 1, an ink printing machine is provided. The machine has at least two ink print heads, preferably four or seven print heads as well as at least one dampening fluid print head for printing on a side of an absorbent printing material, preferably paper, cardboard, or any other natural-fiber-containing material. To print on and dampen the back side, further heads may optionally be provided. The inks and dampening fluid to be applied contain water as a solvent and the dampening fluid is essentially colorless or transparent. The at least two ink print heads apply a multicolor ink image to be printed onto a front side of the printing material. Correspondingly, the at least one dampening fluid print head transfers a dampening fluid image to be printed onto the front side of the printing material. The transfer of the dampening fluid reduces or avoids water-related cockling of the absorbent printing material.

In a step 2, a computer is provided. The computer is in particular used to carry out some of the steps indicated below, in particular steps of calculating, determining, or comparing. The computer is preferably part of a machine control unit and includes a memory for saving data, in particular matrices.

In a step 3, the image to be printed onto the front side of the printing material is provided. The image may in particular be a two- or multicolored image such as an RGB image provided as what is known as a bitmap. The image may be saved on the computer or may be supplied to the computer as a matrix. The image corresponds to the print job to be printed or produced, i.e. the physical print that is actually visible (on the printing material).

In a step 4, color separations of the image that has been provided are created. In this process, n different color separation matrices of the image are calculated with $n \in \mathbb{N}$ and $n \geq 2$. The color separation matrices of the image may be calculated as CMYK matrices or as CMYKOGV matrices (cyan, magenta, yellow, black, orange, green, violet). Thus in the former case, four matrices would be calculated. Every matrix would correspond to one of the four color separations C, M, Y, K. The color separation matrices correspond to the color separations of the multicolor print, which, once printed on top of one another, form the print job.

In a step 5*a*, a relationship $T_1$ between the intensity or optical thickness of the respective elements of the color separation matrices and a corresponding layer thickness or ink amount is provided. The $T_1$ relationship may in general be provided as a function or as a discrete allocation. The $T_1$ relationship may in particular be provided in the form of what is known as the Tollenaar curve. The $T_1$ relationship may be provided jointly for all inks or colors or separately for every ink or color ($T_{1n}$). Thus a calculation may be made in accordance with step 5*b* using the provided relationship $T_1$ from the individual elements of the color separation matrices (intensity values or optical density values). In this process, a corresponding number of ink amount matrices $A_n$ is calculated from the n different color separation matrices of the image. The ink amount matrices thus contain elements that are values of the layer thickness to be created or rather of the ink amounts required for this purpose and not intensity values or optical density values like the color separation matrices. The ink amount matrices correspond to the ink amounts of the respective printing colors that are to be transferred to the printing material for the print job to be produced.

Figure 2:
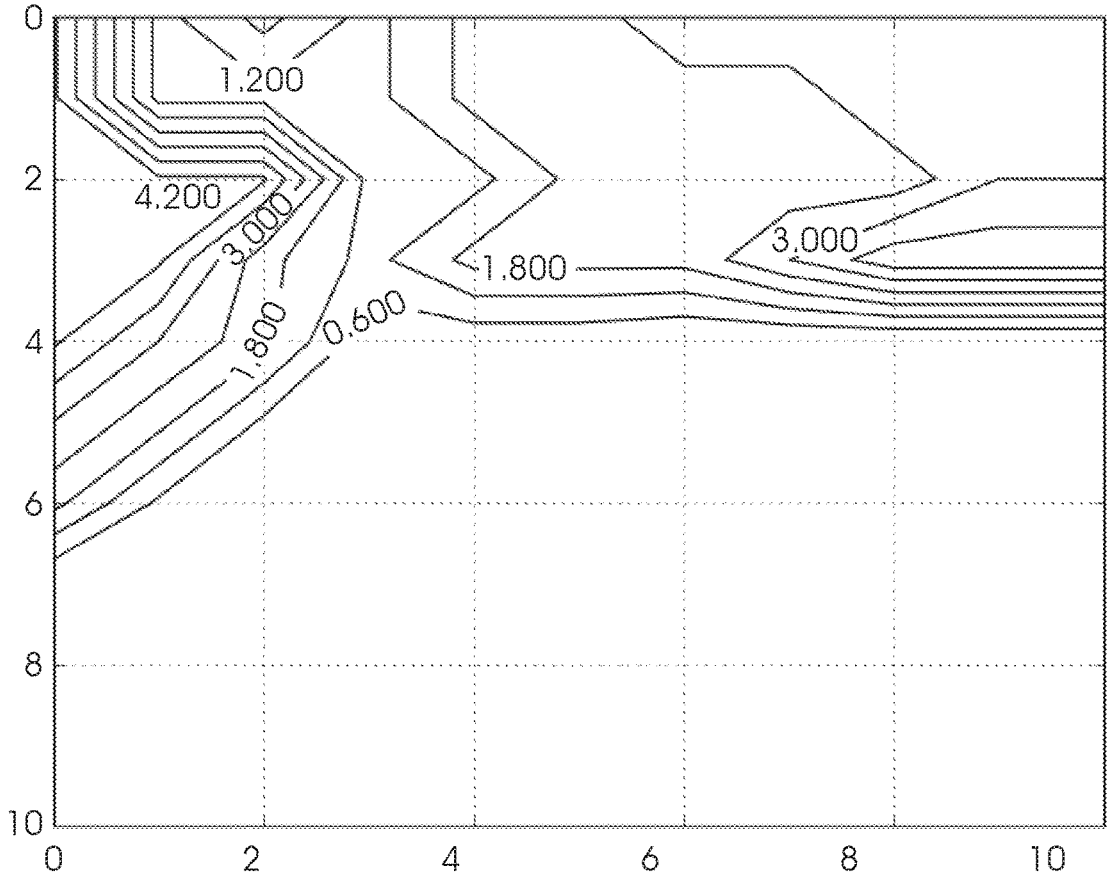
FIG. 2 is an illustration of a preferred exemplary embodiment of an ink amount matrix A.

In a step 6, the previously calculated ink amount matrices $A_n$ are used to calculate a total ink amount matrix A. This may preferably be done by forming a total out of the matrices $A_n$: $A=A_1+A_2+ \ldots +A_n$. The calculation may optionally be made factoring in a respective weighting $g1_n$ of the respective ink amount matrices $A_n$. An example of a total ink amount matrix A is shown in the upper half of FIG. 2 (matrix having lines i and columns j and elements (i, j)). The lower half of FIG. 2 is a graphic representation of the same matrix. The illustrated lines represent values of the matrix that have the same absolute value (corresponding to "contour lines" in a "mountain range" corresponding to the matrix). The total ink amount matrix corresponds to the distribution of the total ink amount to create the print job on the printing material, i.e. the total ink amount at every location on the printed printing material.

Figure 3:
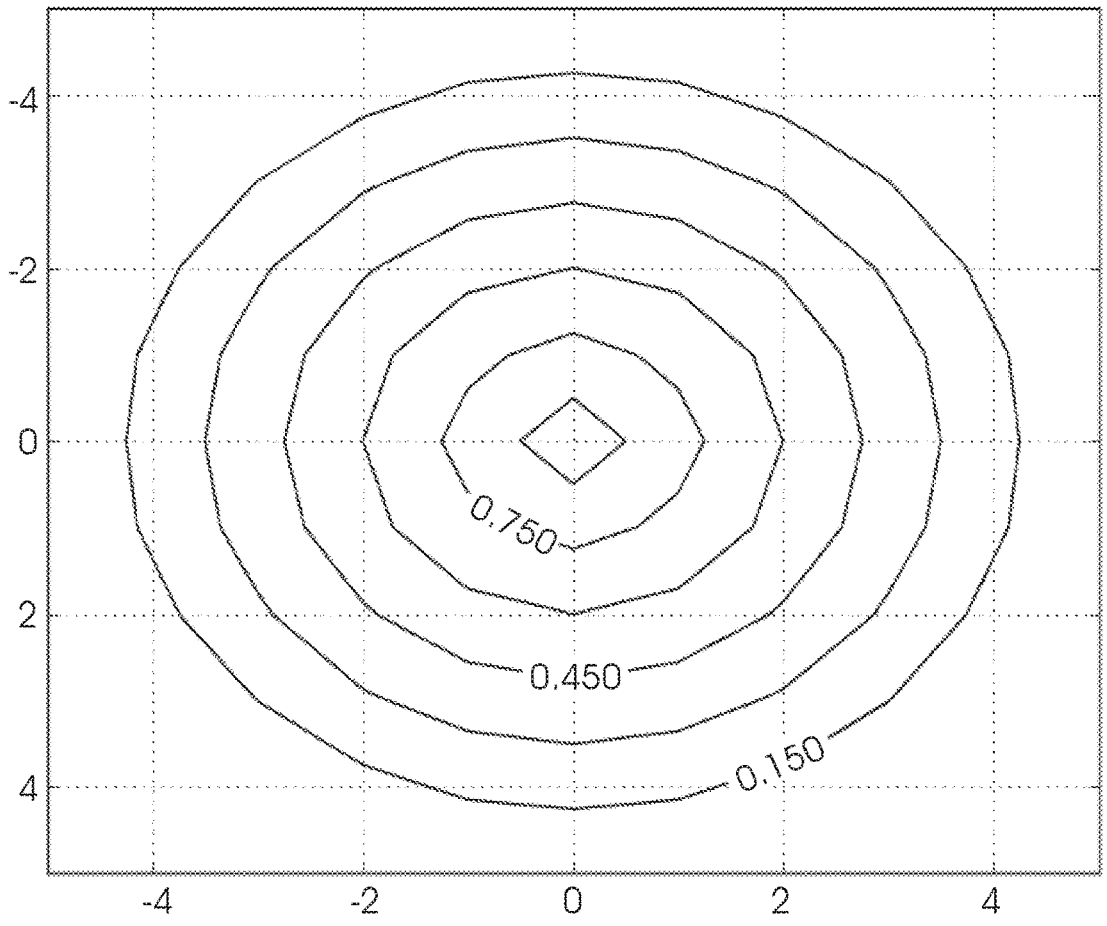
FIG. 3 is an illustration of a preferred exemplary embodiment of a weighting matrix G.
Figure 4:
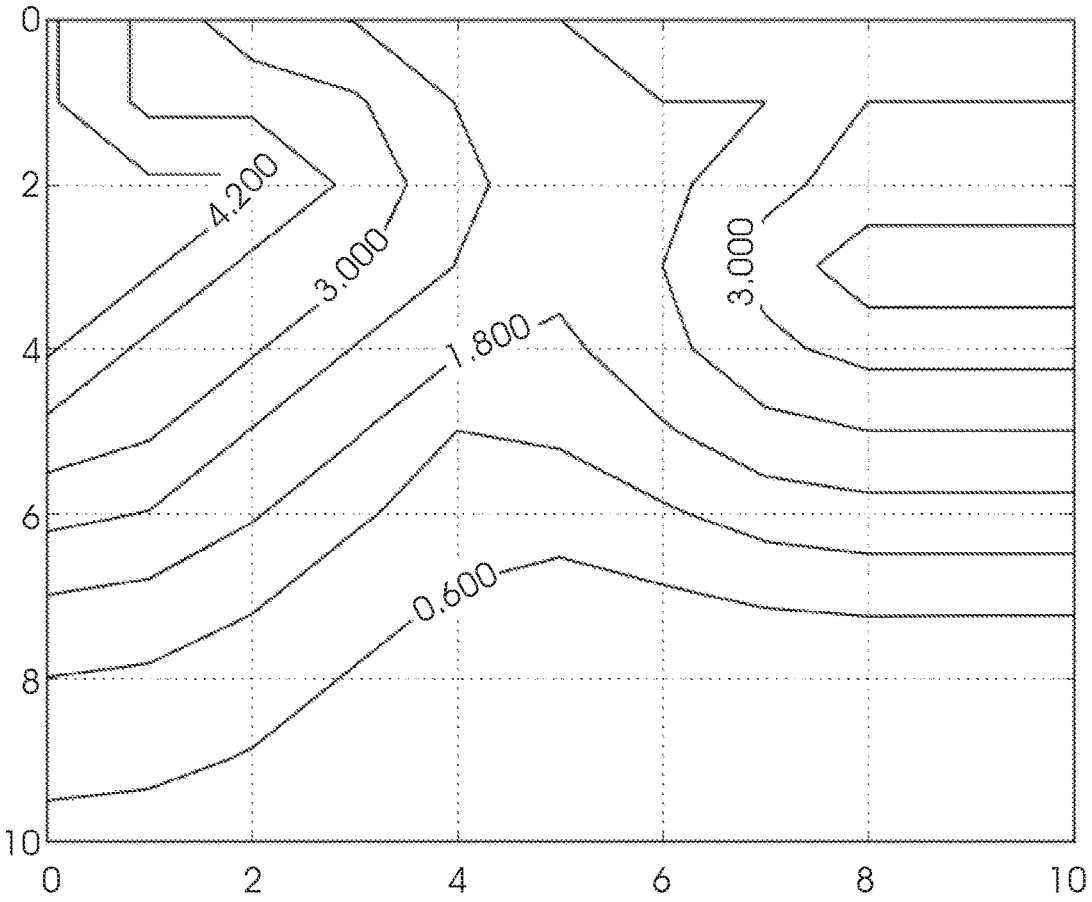
FIG. 4 is an illustration of a preferred exemplary embodiment of a total ink amount matrix B.
Figure 5:
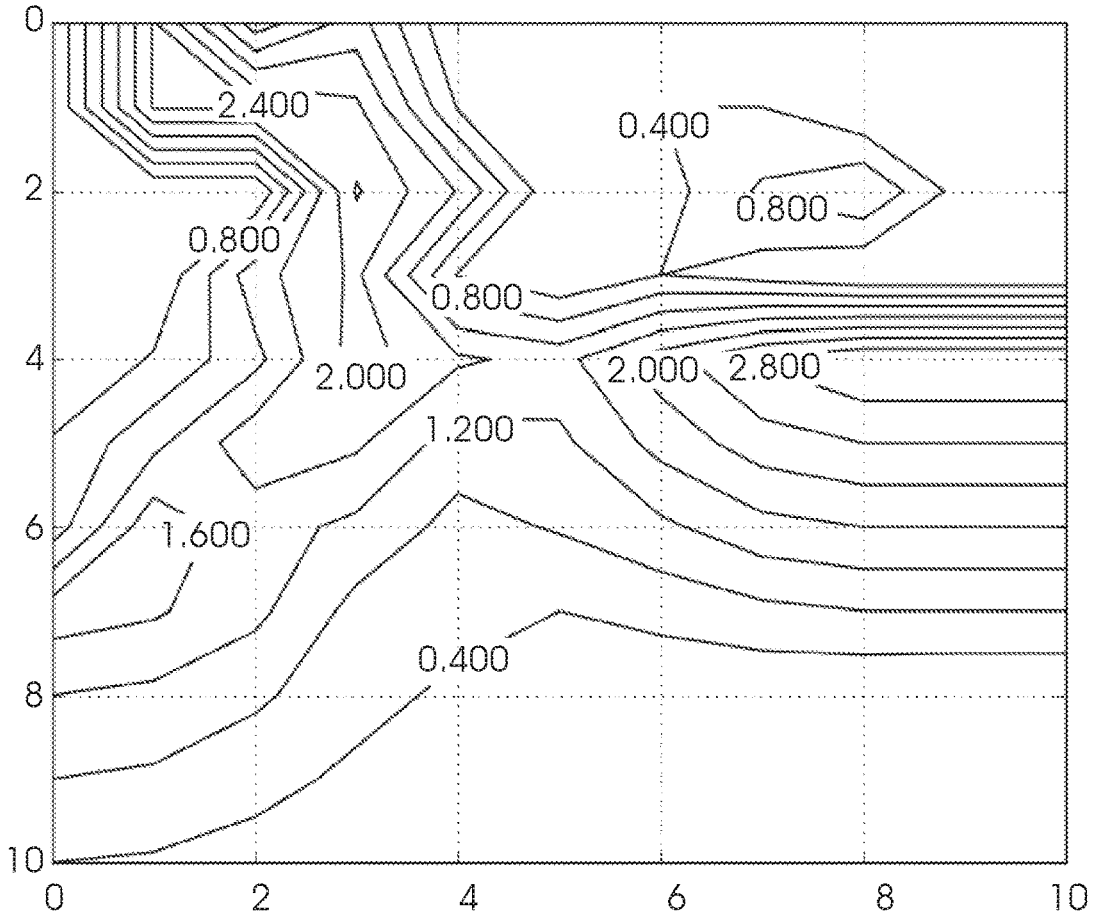
FIG. 5 is an illustration of a preferred exemplary embodiment of a dampening fluid amount matrix C.

In step 7*a*, a weighting matrix G is provided. FIG. 3 shows an example of such a matrix G. The figure shows that the matrix has an essentially cone-shaped structure, i.e. the progression of the absolute values of the matrix elements (i, j) is cone-shaped at the center of the matrix G. The tip of the cone is at the center of the matrix. At the margin, the matrix G is filled with zeroes. Other progressions are likewise possible, but tests have shown such a conical shape to be particularly advantageous. In a step 7*b*, a matrix B is calculated. Such a matrix B is shown in FIG. 4. The calculation is made as follows: For every value A(i,j) of the total ink amount matrix A, a respective matrix Bi,j is calculated by multiplying the total ink amount matrix A by the provided weighting matrix G, which is centered (that is to say whose center, in particular its cone tip, is disposed) at A(i,j). The calculation may be made as a convolution of the matrices. In accordance with a step 7*c*, the maximum $MaxB_{i,j}$ of all elements of the respective matrix $B_{i,j}$ is determined for every such matrix $B_{i,j}$.

In a step 8, a dampening fluid amount matrix C is calculated. In this process, every element (i,j) of the matrix C results from subtracting the value (i,j) of the matrix A from the maximum $MaxB_{i,j}$: $C(i,j)=MaxB_{i,j}-A(i,j)$. The values of $MaxE_{i,j}$ and A(i,j) may be weighted, i.e. a weighting by a factor g2 may be made in the aforementioned subtraction. The value of the weighting g2 may be selected in accordance with the respective water content of the dampening fluid and the inks. The dampening fluid amount matrix C corresponds to the amount of dampening fluid to be transferred to the printing material. This amount has been adapted, in accordance with the invention (in view of reducing or avoiding cockling), to the total ink amount to be transferred.

In a step 9*a*, a relationship $T_2$ between the intensity and the layer thickness (or rather the amount of dampening fluid) is provided. The $T_2$ relationship may in general be provided as a function or as a discrete allocation. The $T_1$ relationship may in particular be provided in the form of what is known as the Tollenaar curve. The relationship $T_2$ may be provided for the dampening fluid, i.e. it may differ from the relationship $T_1$ (or $T_{1n}$). In a step 9*b*, the dampening fluid image to be printed onto the front side of the printing material is calculated from the dampening fluid matrix C. The dampening fluid image may be calculated using the relationship $T_2$ that has been provided. The dampening fluid image and the term "image" are to be understood as corresponding to the (print) image: an (i,j) distribution of intensity values for a fluid to be transferred even though it is colorless.

If only the front side of the printing material receives a print, the method continues at step 12. However, if the back side of the printing material is to receive a print, too, steps 2 to 9*b* are carried out in a corresponding way for the print to be applied to the back side. If both sides of the printing material are to be printed on, an additional step 11 is carried out. This step is to compare the front side value of the ink image or dampening fluid image and the corresponding back-side value of the ink image or dampening fluid at every location to be printed on the printing material. The greater one of the two values obtained by the comparison is transferred from one image to the corresponding other image.

In a step 12, the color separation matrices of ink image are screened using a raster image processor. In a step 13, the dampening fluid image is likewise screened using the raster image processor. If the printing material is to be printed on both sides, the screening steps are carried out both for the front side and for the back side of the printing material.

In a step 14, the ink image is printed onto the front side of the printing material. The same is done for the back side of the printing material if the back side is to be printed on, too.

In a step 15, the dampening fluid image is printed onto the front side of the printing material. Again, the same is done for the back side of the printing material if the back side is to be printed on.

The following is a summary list of reference numerals and the corresponding structure used in the above description of the invention:

1 providing a printing machine including print heads
2 providing a computer
3 providing an image
calculating color separation matrices
5*a* providing relationship $T_1$
5*b* calculating ink amount matrices
calculating total ink amount matrix A
7*a* providing weighting matrix G
7*b* calculating matrix B
7*c* determining maximum $Max_{i,j}$
8 calculating dampening fluid amount matrix C
9*a* providing relationship $T_2$
9*b* calculating dampening fluid image
10 decision
11 comparing and transmitting
12 screening the color separation matrices
13 screening the dampening solution image
14 printing the ink image
15 printing the dampening fluid image

The invention claimed is:

1. A method for printing on an absorbent printing material using inks and dampening fluids, wherein both the inks and the dampening fluids contain water as a solvent and a dampening fluid is colorless, wherein an ink printing machine having at least two ink print heads and at least one dampening fluid print head is provided, wherein the at least two ink print heads apply an ink image to be printed to a front side of the absorbent printing material and the at least one dampening fluid print head applies a dampening fluid image, to be printed to the front side of the absorbent printing material, thus reducing or avoiding water-related cockling of the absorbent printing material, and wherein a computer is provided, which method comprises the following steps of:

a) providing the ink image to be printed onto the front side of the printing material;
b) calculating n different color separation matrices of the ink image with $n \in \mathbb{N}$ and $n \geq 2$;
c) calculating n ink amount matrices $A_n$ from the n different color separation matrices of the ink image;
d) calculating a total ink amount matrix A as $A=A_1+A_2+\ldots+A_n$;
e) calculating a matrix $B_{i,j}$ as $B_{i,j}=G*A$ for every element A(i, j) of the total ink amount matrix A, by multiplying the total ink amount matrix A with a provided weighting matrix G, and determining a maximum $Max_{i,j}$ of a matrix B;
f) calculating a dampening fluid amount matrix C as $C(i,j)=MaxB_{i,}-A(i,j)$;
g) calculating the dampening fluid image to be printed onto the front side of the absorbent printing material from the dampening fluid image matrix C;
h) screening the n different color separation matrices of the ink image using a raster image processor;
i) screening the dampening fluid image using the raster image processor;
j) printing the ink image; and
k) printing the dampening fluid image.

2. The method according to claim 1, wherein the n different color separation matrices of the ink image are calculated as CMYK or CMYKOGV matrices.

3. The method according to claim 1, which further comprises calculating the n ink amount matrices $A_n$, using a relationship $T_1$ between intensity or optical density and layer thickness.

4. The method according to claim 1, wherein a respective weighting g1$_n$ of the n ink amount matrices $A_n$ is factored in when the total ink amount matrix A is calculated.

5. The method according to claim 4, wherein in terms of progression of values of elements G(i,j) thereof, the weighting matrix G is provided as a matrix that is cone-shaped at a center and filled with zeroes at margins.

6. The method according to claim 1, wherein a weighting g2 of the maximum $MaxB_{i,j}$ of the matrix B and the elements A(i,j) of the total ink amount matrix A in accordance with a respective water content of the dampening fluid and the inks is factored in when the dampening fluid matrix C is calculated.

7. The method according to claim 1, which further comprises calculating the dampening fluid image using a provided relationship $T_2$ between intensity and layer thickness.

8. The method according to claim 1, which further comprise:

repeating steps a)-g) for a further image to be printed onto a back side of the absorbent printing material;
comparing the ink image or a dampening image value of the front side image and a corresponding back-side value of ink or the dampening fluid image on the back side at every printing material location to be printed on; and
transferring a greater value obtained in a comparison for one image to a corresponding other image.

9. The method according to claim 1, wherein the dampening fluid print head has a lower print resolution than the ink print heads.

10. The method according to claim 1, wherein the computer is provided to carry out calculating, determining, and comparing steps.

11. The method according to claim 1, wherein:
the dampening fluid image surrounds; and
the ink image is an RGB image.

12. The method according to claim 3, wherein the step of calculating the ink amount matrices $A_n$ using the relationship $T_1$ between the intensity or the optical density and the layer thickness uses a Tollenaar curve.

13. The method according to claim 7, which further comprises calculating the dampening fluid image using a Tollenaar curve or an inverse thereof.

* * * * *